US006371689B1

(12) United States Patent
Wiley

(10) Patent No.: US 6,371,689 B1
(45) Date of Patent: Apr. 16, 2002

(54) METHOD OF AND APPARATUS FOR HEATING A ROAD SURFACE FOR REPAVING

(75) Inventor: Thomas William Wiley, Richmond (CA)

(73) Assignee: Dynaire Industries, Ltd., Richmond (CA)

( * ) Notice: Subject to any disclaimer, the term of this patent is extended or adjusted under 35 U.S.C. 154(b) by 0 days.

(21) Appl. No.: 09/429,032

(22) Filed: Oct. 29, 1999

(51) Int. Cl.[7] ..... E01C 23/14
(52) U.S. Cl. ..... 404/77; 404/79; 404/95
(58) Field of Search ..... 404/72, 75, 77, 404/79, 93, 95, 91, 124, 121

(56) References Cited

U.S. PATENT DOCUMENTS 3,221,619 A * 12/1965 Erickson ..... 404/124
3,891,979 A * 6/1975 Braun et al. ..... 340/234
4,061,463 A * 12/1977 Bennett ..... 431/9
4,559,922 A 12/1985 Crupi et al.
4,561,800 A 12/1985 Hatakenaka et al.
4,784,518 A * 11/1988 Cutler ..... 404/79
4,793,730 A * 12/1988 Butch ..... 404/77
4,850,740 A 7/1989 Wiley
5,026,205 A * 6/1991 Gorski et al. ..... 404/72
5,199,354 A * 4/1993 Wood ..... 110/241
5,419,178 A * 5/1995 Decker et al. ..... 73/23.1
5,653,552 A 8/1997 Wiley et al.
5,762,446 A * 6/1998 Manatt et al. ..... 404/75
5,791,814 A 8/1998 Wiley
5,860,764 A * 1/1999 Roberts ..... 404/93
5,895,171 A 4/1999 Wiley et al.
5,895,172 A * 4/1999 Grembowicz et al. ..... 404/79

* cited by examiner

*Primary Examiner*—Thomas B. Will
*Assistant Examiner*—Raymond Addie
(74) *Attorney, Agent, or Firm*—Oyen Wiggs Green & Mutala

(57) ABSTRACT

A method and apparatus for heating an asphalt-paved road surface by forcing gases heated by a heater against that road surface and then returning those gases to the heater for reheating and recirculation, wherein the temperature of the returning gases is measured by a temperature sensor, and the heater is automatically adjusted so that the temperature of the gases being directed against the road surface is automatically decreased as the temperature of the returning gases increases. This prevents damage to the asphalt and premature rupturing of the road surface.

10 Claims, 2 Drawing Sheets

METHOD OF AND APPARATUS FOR HEATING A ROAD SURFACE FOR REPAVING

TECHNICAL FIELD

The present invention relates to a method of, and apparatus for, heating an asphalt-paved road surface.

BACKGROUND

As used herein, the term "asphalt" is meant to include macadam and tarmac. As is known in the art, asphalt-paved road surfaces typically comprise a concrete mixture of asphalt cement (typically a black, sticky, petrochemical binder) and an aggregate comprising appropriately sized stones, gravel, and/or sand. The asphalt concrete mixture is usually laid, compressed, and smoothed to provide an asphalt-paved road surface.

Conventionally, in repair work of roads paved with asphalt concrete, the road surfaces are, prior to the repair work, softened through heating thereof by road surface heating apparatuses, each typically mounted on a vehicle. It is necessary to soften old asphalt so that a satisfactory bond is formed between the old asphalt and subsequently applied new asphalt. Softening is also required where portions of the old asphalt are to be recycled into the new pavement. Such recycling generally operates on the premise of (1) heating the paved surface to soften an exposed layer of asphalt using direct flames, infrared burners, radiant heaters, hot air blowers, or other heating means; (2) mechanically breaking up the heated surface, typically using devices such as rotating, toothed grinders; screw auger/mills; and rake-like scarifiers; (3) applying fresh asphalt and/or asphalt rejuvenant to the heated, broken asphalt; (4) distributing the mixture over the road surface; and (5) compacting or pressing the distributed mixture to provide a recycled asphalt-paved surface.

U.S. Pat. No. 5,653,552 issued to Wiley and U.S. Pat. No. 5,791,814 issued to Wiley et al. discuss in great detail a number of problems in respect of heating, softening, and rupturing old asphalt. For example, asphalt concrete (especially the asphalt cement within it) is susceptible to damage from heat, usually when the asphalt mixture is heated to a temperature above approximately 320° F. (160° C.), although old asphalt pavement can usually be heated to a temperature approaching the flash point of asphalt (about 210° C. or 410° F.) since the surface oil on the pavement has typically been worn off, washed away, or severely oxidized. Another problem in this regard is the increasing difficulty of heating asphalt concrete as the depth of the layer being heated increases. A further problem results from excess heating and/or smoking of the asphalt surface which can lead to a negative impact on the environment.

To this end, U.S. Pat. No. 5,653,522 and U.S. Pat. No. 5,791,814 discuss in detail numerous attempts in the prior art to deal with the inherent difficulty of adequately and uniformly heating an asphalt surface in an efficient manner while minimizing or eliminating burning and smoking of the asphalt surface. Much of this effort involved utilizing relatively complicated means to distribute heat through the asphalt surface after rupturing thereof, often requiring further heating of the ruptured asphalt surface to facilitate heat distribution therethrough. These complicated processing means were typically cumbersome and large, yet were necessary due to the inability to preheat the unruptured asphalt surface adequately without overheating thereof.

U.S. Pat. No. 4,561,800 issued to Hatakenaka et al. and U.S. Pat. No. 4,559,922 issued to Crupi et al. teach the use of blowing hot air (or other gases) to heat and soften a road surface, and then recirculating and reheating those hot gases. In particular, each patent teaches an apparatus having an enclosure with a bottom peripheral wall positionable in engagement with a road surface, a heater, a duct for conveying hot gases from the heater to the enclosure and to the road surface under the enclosure, a duct for recycling gases after their contact with the road surface back to the heater for reheating, and a fan for circulating the hot gases through the ducts. According to these patents, using blowing hot gases resolves problems with direct flame and radiant heating means for heating a road surface, namely that the combination of the heat applied in accordance with those means and the oxygen in the atmosphere tended to oxidize the asphalt and drive off relative volatile components, thereby causing deterioration of the quality of the asphalt as well as releasing objectionable pollutants into the air. In contrast, by recirculating hot gases, minimal pollutants are released into the surrounding atmosphere and the hot gases can be controlled so as to have very little oxygen, thereby minimizing oxidation of the asphalt. Another problem with direct flame and infrared burners is that they result in non-uniform heating of the road surface, with the portions closely confronting the burners being overheated and burned, while other portions are underheated. By instead blowing hot gases uniformly across the road surface, Hatakenaka et al. and Crupi et al. provide a means of more uniformly heating a road surface.

Hatakenaka et al. goes one step further than Crupi et al., in that Hatakenaka et al. also teaches the use of a thermal control to maintain the hot gases in the duct leaving the heater at a constant, pre-determined temperature. However, this still would not prevent the possibility of overheating the road surface since Hatakenaka et al. does not disclose means by which the temperature of the road surface is taken into account and by which the constant, pre-determined temperature of the hot gases can be automatically reduced as the road surface approaches the flash point of the asphalt.

All of the prior art continues to exhibit a persistent problem in controlling the heat source in such a manner that the heat being produced is relative to only what is required to efficiently heat the asphalt material without causing damage. In addition, the prior art processes and apparatuses generally require that the material be heated only from the top of the road surface or in combination with a secondary heating step that applies heat to ruptured material. While rupturing the material and exposing more free oil creates a black surface that more readily absorbs infrared waves, it has been discovered that heating this exposed oil in loosened material greatly increases the amount of deterioration in the asphalt due to heat. Accordingly, it is preferable to heat the asphalt surface sufficiently prior to rupturing.

SUMMARY OF INVENTION

The present invention provides an improved method and apparatus for heating an asphalt-paved road surface to soften it prior to initiating repair work. This method and apparatus involves forcing gases heated by a heater against that road surface and then returning those gases to the heater for reheating and recirculation, wherein the temperature of the returning gases is measured by a temperature sensor, and the heater is automatically adjusted so that the temperature of the gases being directed against the road surface is automatically decreased as the temperature of the returning gases increases. This prevents damage to the asphalt and premature rupturing of the road surface.

In particular, the method according to the present invention comprises: (1) heating gases adjacent the heater; (2)

forcing gases heated by the heater into contact with the road surface; (3) collecting the gases after they have been forced against the road surface and returning them to the heater; (4) measuring the temperature of the gases as they are returned from the road surface to the heater; and (5) adjusting the heater so that the temperature to which gases are heated by the heater decreases as the temperature of the returned gases increases. To this end, a road surface heating apparatus according to the present invention comprises: (1) a heater for heating gases; (2) at least one manifold for directing heated gases from the heater against a road surface; (3) an enclosure for trapping gases exiting that manifold against the road surface; (4) a fan for returning gases which have been directed against the road surface back to the heater for reheating and recirculating; and (5) a temperature sensor for measuring the temperature of gases being returned to the heater, wherein the heater of this heating apparatus provides heated gases at a temperature that decreases as the temperature measured by the temperature sensor increases. This apparatus could further comprise a venturi valve through which the fan directs returning gases at high velocity to the heater, creating a low pressure area sufficient to allow the heater to be no more than a natural aspirated burner introduced into the air stream to reheat the gases and combust any fumes collected. The temperature sensor can be a simple thermocouple.

The efficiency of this method and apparatus can be improved even further by doing the following: once the road surface has been heated for a period of time according to the method and apparatus described above, grooves can be pressed into the heat-softened road surface (for example, by a flanged reforming drum) without rupturing it. This prepares the road surface for further and deeper and more effective heating in accordance with the method and apparatus described above.

After completion of heating and softening of a road surface in accordance with the method and apparatus described above, the road surface can then be ruptured (for example, by a rupturing drum) and the ruptured material can then be reused in new pavement for the road surface.

DESCRIPTION

The present invention provides an improved method and apparatus for heating an asphalt road surface without overheating the asphalt material. The method and apparatus according to the invention directs impinging jets of hot gases at the road surface in such a way and with sufficient velocity so as to prevent the buildup of a cooler boundary layer near the top of the road surface. Further, rather than simply directing hot air (or other gases) of a constant, predetermined temperature at the road surface, the present invention takes into account the temperature of the road surface and automatically adjusts the temperature of the impinging hot gases to only what is required to heat the road surface to the desired temperature. In this way, the road surface can be uniformly and consistently heated to optimal temperatures for repairing or recycling the asphalt pavement without damaging the road surface.

Figure 1:
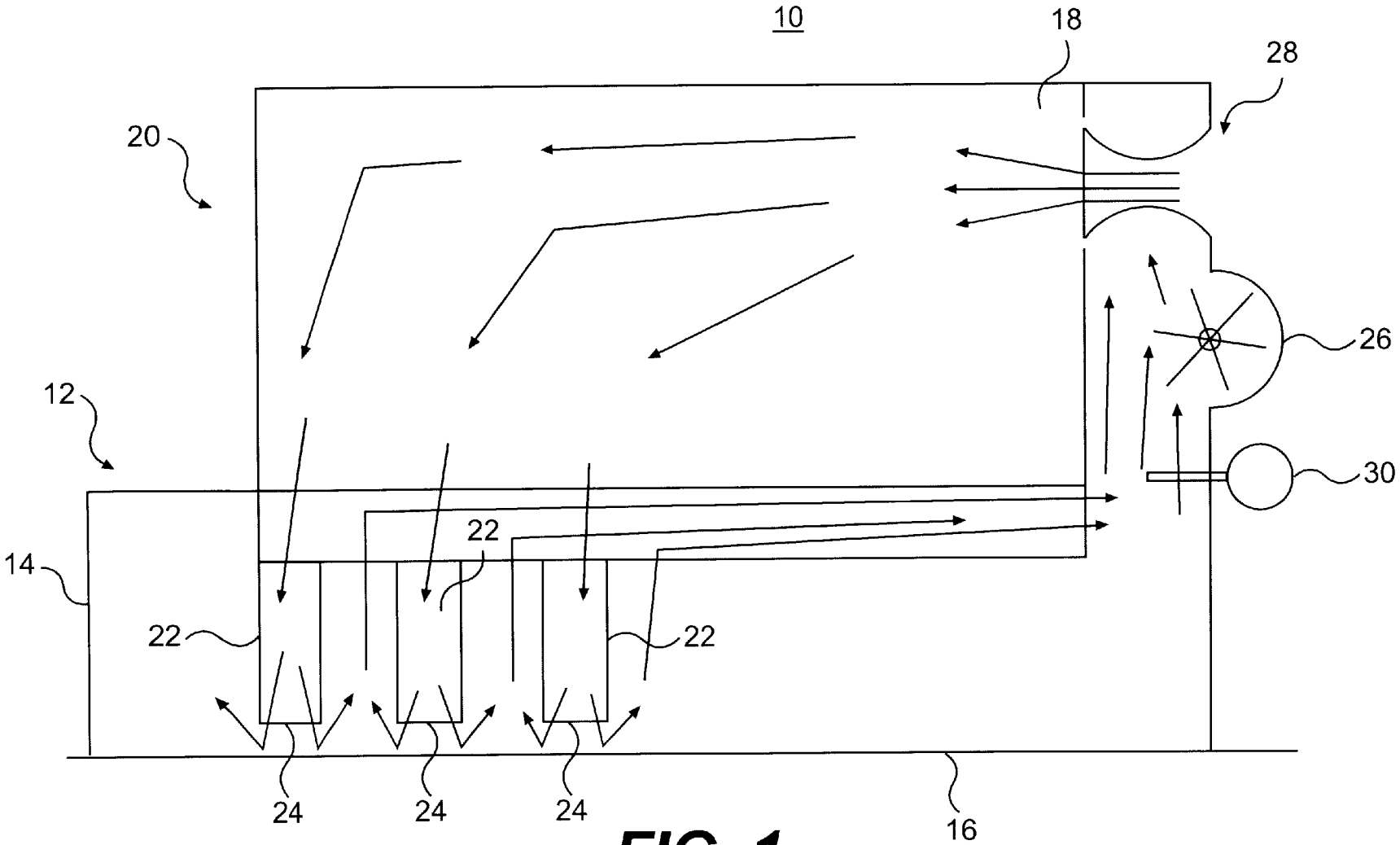
FIG. 1 is a schematic view of a road surface heating apparatus according to an embodiment of the present invention.

Referring to FIG. 1, a heating apparatus 10 that uses circulating hot gases to heat a road surface, according to one embodiment of the present invention, comprises an enclosure 12 having a flexible skirt or other bottom peripheral wall 14 positionable in engagement with a road surface 16 for containing hot gases therein. Heating apparatus 10 further comprises a heater 18 for heating the hot gases in a combustion chamber 20, and manifolds 22 which direct impinging jets of hot gases from combustion chamber 20 through apertures 24 to the road surface 16 where heat from those hot gases is absorbed. Enclosure 12 largely prevents the release of gases to the surrounding atmosphere. A fan 26, which can be a simple mild steel fan, collects the spent gases from the enclosure 12 after the gases have contacted the road surface 16 and then fan 26 accelerates and drives the returning gas at high velocity through a venturi valve 28 back to heater 18. The venturi valve 28 creates a low pressure area in combustion chamber 20 sufficient to allow heater 18 to be no more than a natural aspirated burner introduced into the air stream to reheat the gases and combust any fumes collected, thereby eliminating the need for an expensive pressure burner. The manifolds 22 are spaced to provide ample room therebetween for spent gases to be recollected and directed by fan 26 back to heater 18 without undue restriction.

It has been discovered that the temperature of the road surface 16 is substantially directly proportional to the temperature of the gases leaving the road surface and being recirculated back to heater 18. Accordingly, heating apparatus 10 further comprises a temperature sensor 30 which measures the temperature of the gases returning to the heater 18, and adjusts heater 18 accordingly so as to provide impinging hot gases of a temperature suitable to heat road surface 16 to an optimal temperature, Temperature sensor 30 can be a simple thermocouple or any other temperature measuring device.

In practice, when first exposed to the heating process, road surface 16 absorbs a great deal of energy and so the temperature of the returning gases is low. As the temperature of the road surface 16 rises, less energy is transferred and the temperature of the returning gases also rises. At a preset point, the operating level of heater 18 is reduced to reduce the temperature of the gases being directed at the road surface 16, thereby preventing damage to the road surface 16.

For example, heater 18 initially provides hot gases at a temperature not higher than 1000° F. (approximately 538° C.) to start heating road surface 16. After a period of time, the temperature of road surface 16 will typically rise as high as 320° F. (160° C.) at which point heater 18 will provide gases at a temperature of only approximately 700° F. (371° C.). Theoretically, although uncommon, the temperature of road surface 16 may increase to as high as 350° F. (approximately 177° C.), at which point heater 18 will have been adjusted to provide hot gases at a temperature of only approximately 650° F. (343° C.).

Except for a minor amount of leakage of gases to the atmosphere from the enclosure 12 between the bottom peripheral wall 14 and road surface 16, the hot gases are continually recirculated and reheated. The heater 18 can be readily operated with a fresh air intake just sufficient to effect combustion of fuel, so that the hot gases directed at the road surface 16 may be substantially free of oxygen, with there subsequently being no oxidation of the asphalt being softened. Further, any fumes produced by heating the asphalt in the road surface 16 will be directed to and incinerated by heater 18.

Figure 2:
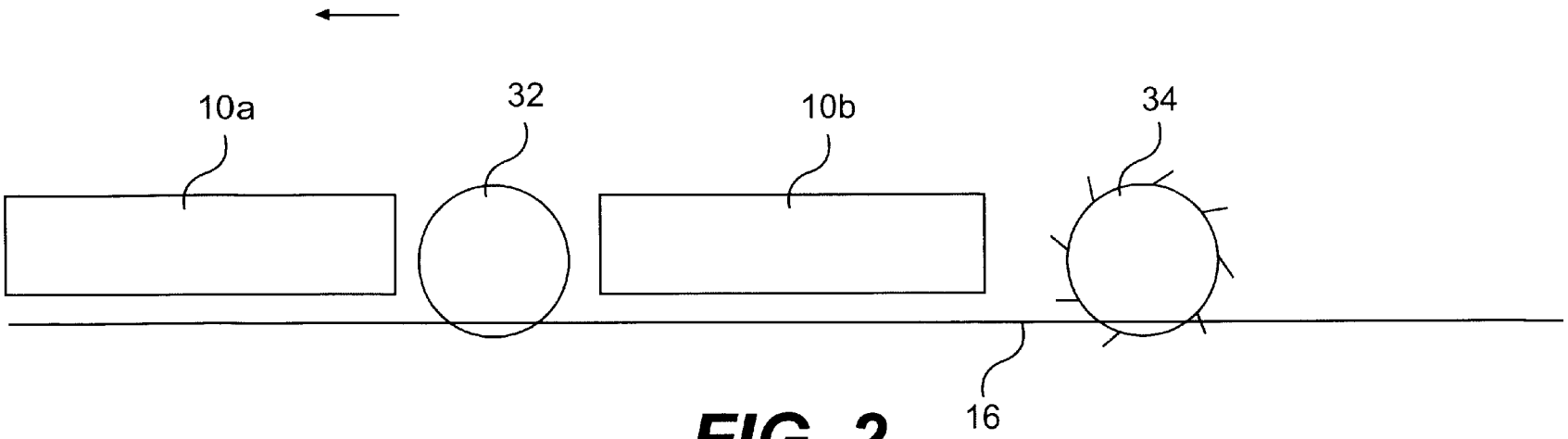
FIG. 2 is a schematic view of road surface heating apparatuses according to the present invention used in combination with a reforming drum and a rupturing drum.
Figure 3:
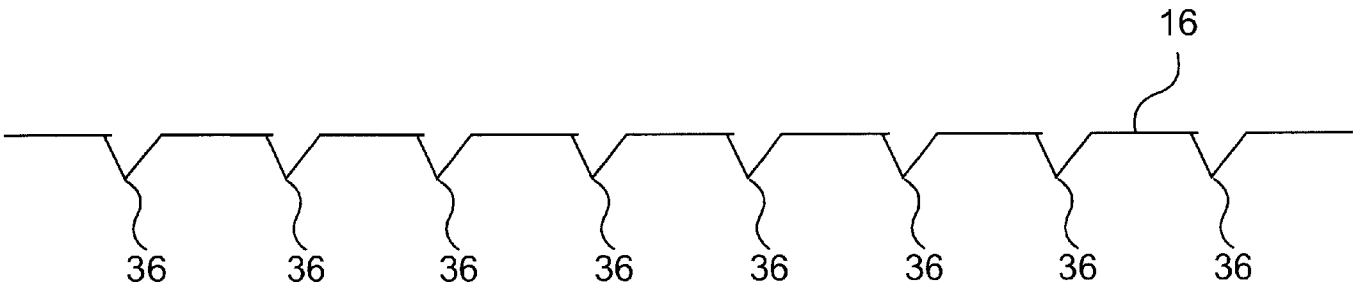
FIG. 3 is a horizontal cross-sectional view of a road surface after the reforming drum of FIG. 2 has been applied thereto.

FIG. 2 and FIG. 3 illustrate a manner in which the efficiency of the method and apparatus according to the invention can be improved even further. FIG. 2 illustrates how two heating apparatuses 10*a* and 10*b* (each identical to heating apparatus 10 described above) can be combined with a flanged reforming drum 32 and a rupturing drum 34 to efficiently heat and remove material from road surface 16. As heating apparatus 10*a*, reforming drum 32, heating apparatus 10*b*, and rupturing drum 34 are collectively moved in the direction of the arrow in FIG. 2 over road surface 16, heating apparatus 10*a* causes that portion of road surface 16 affected by heating apparatus 10*a* to soften, after which the flanges of reforming drum 32 press grooves 36 into softened road surface 16 by compacting the softened material without rupturing it, resulting in road surface 16 having a dense and grooved, but unruptured, surface as shown in FIG. 3. This serves to (1) increase the density of road surface 16, causing rocks embedded in road surface 16 to move into contact with one another and thereby enhancing heat transfer from rock to rock; (2) press a depressed groove into road surface 16, thereby allowing the jet of hot gases from heating apparatus 10*b* access to a deeper level of rocks; and (3) increase the surface area available to absorb heat from the hot gases from heating apparatus 10*b*. Therefore, grooves 36 allow heat from heating apparatus 10*b* to penetrate deeper and faster over a larger surface area without exposing the oil in the material to more damage. As rocks and densely packed material transfer heat more efficiently than oil or loose materials, the use of reforming drum 32 improves the effective heating of road surface 16. In other words, the rock component of road surface 16 has a much higher rate of thermal conductivity than the asphalt cement component, making it advantageous to apply heat to the existing polished road surface 16 rather than a ruptured, loose, oil covered surface as taught by the prior art. Only after road surface 16 is thoroughly and deeply heated and softened does rupturing drum 34 rupture the heated material so that it can be improved and perhaps pressed into a recycled asphaltic surface.

The method and apparatus according to the present invention can be used to advantage with any of the asphalt recycling processes described in the prior art, and are suitable for use both as a static process or a moving process utilizing one or more heating apparatus 10 in a modular fashion to improve performance and efficiency.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method of subjecting a road surface to gases heated by a heater to prepare the surface for repair work, comprising:

heating gases adjacent the heater;

forcing gases heated by said heater into contact with said road surface;

collecting the gases after they have been forced against said road surface and returning them to said heater;

measuring the temperature of the gases as they are returned from said road surface to said heater; and adjusting said heater so that the temperature to which gases are heated by said heater decreases as the temperature of the returned gases increases.

2. The method of claim 1 further comprising pressing grooves into the heated road surface.

3. The method of claim 1 or claim 2 further comprising rupturing the road surface, and reusing the ruptured material in new pavement for said road surface.

4. A road surface heating apparatus for applying heated gases to a road surface to soften same prior to initiating repair work, comprising:

a heater for heating gases;

a manifold for directing heated gases from said heater against a road surface;

an enclosure for trapping gases exiting said manifold against said road surface;

a fan for returning gases which have been directed against said road surface back to said heater for reheating and recirculating; and a temperature sensor for measuring the temperature of gases being returned to said heater, wherein said heater provides heated gases at a temperature that decreases as the temperature measured by said temperature sensor increases.

5. The apparatus of claim 4 further comprising a venturi valve through which said fan directs returning gases to said heater.

6. The apparatus of claim 5 wherein said heater is a natural aspirated burner.

7. The apparatus of claim 4 wherein said temperature sensor is a thermocouple.

8. The apparatus of claim 4 further comprising an apparatus for pressing grooves into said road surface.

9. The apparatus of claim 8 wherein said apparatus for pressing grooves is a flanged reforming drum.

10. The apparatus of claim 4 or 8 further comprising an apparatus for rupturing said road surface.

* * * * *